US005468278A

United States Patent [19]

Nakahara et al.

[11] Patent Number: 5,468,278

[45] **Date of Patent: * Nov. 21, 1995**

[54] CERMET ALLOY

[75] Inventors: Yuichi Nakahara, Narita; Katsuhiko Kojo, Fukaya, both of Japan

[73] Assignee: Hitachi Metals, Ltd., Tokyo, Japan

[ * ] Notice: The portion of the term of this patent subsequent to Sep. 28, 2010, has been disclaimed.

[21] Appl. No.: 149,939

[22] Filed: Nov. 10, 1993

[30] Foreign Application Priority Data

Nov. 11, 1992 [JP] Japan ..... 4-326162
May 21, 1993 [JP] Japan ..... 5-142709

[51] Int. Cl.[6] ..... C22C 29/00
[52] U.S. Cl. ..... 75/236; 75/238; 75/242
[58] Field of Search ..... 75/238, 240, 242, 75/236

[56] References Cited

U.S. PATENT DOCUMENTS 3,878,592 4/1975 Humenik, Jr. et al. ..... 29/95 D
3,917,463 11/1975 Doi et al. ..... 75/0.5 BC
4,019,874 4/1977 Moskowitz ..... 75/241
5,145,505 9/1992 Saito et al. ..... 75/238
5,248,352 9/1993 Nakahara et al. ..... 148/421

FOREIGN PATENT DOCUMENTS 1192726 5/1970 United Kingdom ..... C22C 29/00
1204802 9/1970 United Kingdom ..... C22C 29/00

*Primary Examiner*—Ngoclan Mai
*Attorney, Agent, or Firm*—Sughrue, Mion, Zinn, Macpeak & Seas

[57] ABSTRACT

This invention provides a cermet alloy having a structure comprising a hard phase and a bonding phase, wherein the hard phase comprising carbide particles rich An TiC, those rich in WC and (Ti, W, MO)C or (Ti, W, Mo)(C, N) and the bonding phase comprising at least one of Co and Ni. Mo contents in the bonding phase satisfies the conditions: 1.0≦Mo (wt %)/Ti (wt %) and 6 (wt %)≦Ti+Mo. The cermet alloy has superior hardness and toughness as well as improved heat resistance and is applicable as a material for a wet machining tool.

3 Claims, 11 Drawing Sheets

CERMET ALLOY

FIELD OF THE INVENTION

The present invention relates to a cermet alloy with high strength and high toughness obtained through enhancement of a bonding phase.

BACKGROUND OF THE INVENTION

The base of cermet alloys used for tools are usually titanium carbide, which has nitrogen content (hereinafter referred to as Ti(C,N)). The Ti (C, N) base cermet alloy is superior to conventional titanium carbide (hereinafter referred to as TiC) base cermet alloy in many properties such as room temperature strength, oxidation resistance and machinability.

Both the TiC based and the Ti(C,N) based cermet alloys have a hard phase comprising particles in a composite core/shell structure where the core (TiC for the former and Ti(C,N) for the latter) is surrounded by the peripheral structure of (Ti, Mo)C and (Ti, Mo)(C, N), respectively. The Ti(C,N) base alloy has a finer particle size under the effect of nitrogen content, which realizes improved toughness.

The Ti(C,N) base cermet alloy is also known for having an excellent high-temperature strength.

This advantage attributes to the bonding phase having more solid solution of Mo, which suppresses dynamic restoration of the phase. The mechanism where Mo solid solution is formed in the bonding phase is supposed that Ti, which is supersaturated from Ti(C,N) in denitrification during vacuum sintering, forms a carbide together with C from $Mo_2C$ with the remaining Mo making solid solution in the bonding phase.

Recently, wet machining is often adopted for better environment at machining sites. In such cases, it is required that the tool material has higher hardness and toughness, as well as excellent heat resistance so as to prevent property degradation under the effect of the heat during machining and cooling with machining fluid.

SUMMARY OF THE INVENTION

It is an object of the present Invention to provide a cermet alloy with excellent toughness and hardness as well as improved heat resistance.

The object of the invention is achieved by enhancing a bonding phase with more Mo solid solution in the phase and forming a novel hard phase structure by selection of materials as Ti solid solution.

To have more Mo solid solution in the bonding phase, a metallic Mo is used as the Mo source. Though an increase in the amount of added metallic Mo causes more Mo solid solution in the bonding phase, it is found that a simple increase of the Mo solid solution in the bonding phase is not enough to enhance the phase. The bonding phase is enhanced only when the Mo solid solution amount is in a certain relation with the Ti solid solution amount in the bonding phase.

Ti solid solution, e.g. TiCN and (Ti, W)C, are used as well as metallic Mo in the present cermet alloy production to form the hard phase having a structure where particles rich in TiC and those rich in WC exist independently from each other.

The cermet alloy according to the present invention comprises a hard phase and a bonding phase. The hard phase contains TiC and TiN, or TiCN, and the bonding phase mainly comprises at least one of Co and Ni. The alloy is characterized in that it satisfies the following condition:

$$1.0 \leqq \text{Mo (wt. \%)}/\text{Ti (wt \%)},\ 6\ \text{(wt. \%)} \leqq \text{Ti+Mo}$$

For enhancement of the bonding phase, Ti and Mo contents in the bonding phase must be adjusted so that 6 wt. %≦Ti+Mo. Ti and Mo contents are given in weight percent in the bonding phase, and can be determined by means of ICP (inductively coupled plasma) emission spectral analysis method.

For high toughness and hardness, the Mo and Ti contents must be adjusted so that 1.0≦Mo (wt. %)/Ti (wt. %). This is because an excessive Ti amount in the bonding phase reduces toughness.

Upon increase of at least one of Co and Ni mainly constituting the bonding phase, the amount of hard phase relatively decreases with lowering the hardness. Therefore, the amount of at least one of Co and Ni is preferably adjusted to be 15 vol. % at most, and more preferably, 10 vol. % or less.

DETAILED DESCRIPTION OF THE INVENTION

Figure 1:
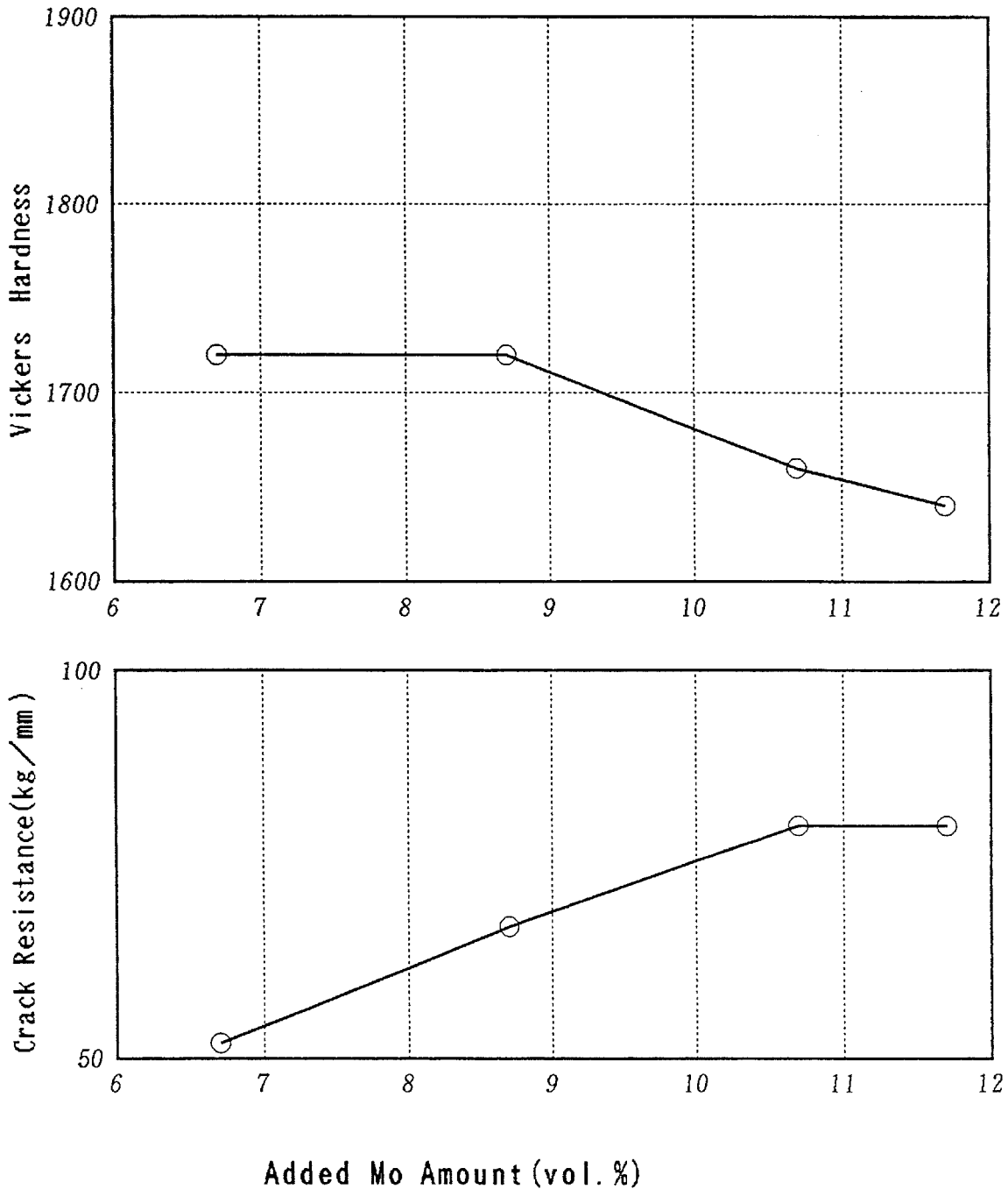
FIG. 1 is a graph to show the relation between added Mo amount and hardness/crack resistance when 5 vol. % of TiN is added in Example 1.

A cermet alloy according to the present invention can be provided with a hard phase by addition of TiC powder and TiN powder as hard phase forming materials. Such additional TiC and TiN powders usually generate Ti(C,N) during the sintering process, but they may remain in the sintered subject when the powders are fine. Thus, addition of Mo to the TiC and TiN powders for bonding phase enhancement causes generation of (Ti,Mo)(C,N) as the hard phase.

The present invention allows addition of other carbides. In particular, tungsten carbide (WC) is effective for improved sintering property. The amount of WC to be added is preferably from 5 vol. % (inclusive) to 50 vol. % (inclusive). When WC is less than 5 vol. %, the effect of sintering property improvement cannot be obtained sufficiently. When added WC is over 50 vol. %, on the other hand, cutting dust deposition cannot be ignored in the machining tool application. Addition of WC to the TiC and TiN powders forms solid solution of (Ti, W, Mo) (C, N) as the hard phase.

The bonding phase mainly contains at least one of Co and Ni, and further contains Mo as an enhancing element and Ti as a component element of the hard phase. When WC is used for the hard phase, W is also contained.

When the content of at least one of Co and Ni increases and adds to the bonding phase amount, the hard phase amount relatively decreases with lowering the hardness. Therefore, it is preferable to limit the amount of at least one of Co and Ni to 15 vol. % at most, and more preferably, 10 vol. % at most.

According to the present Invention, a cermet alloy comprises a hard phase and a bonding phase. The hard phase has a composite core/shell structure. When (Ti, W, Mo)(C,N) solid solution is formed as the hard phase, the structure comprises a core relatively rich in Ti and N and poor in W and Mo and a peripheral structure relatively rich in more (W, Mo)C and poor in Ti and N. The peripheral structure also contains a little Co and Ni. Mo content in the peripheral structure arises from Mo added for bonding phase enhancement.

The cermet alloy of the present invention is characterized by the following two points:

(1) Mo serving as the bonding phase enhancing element is added as metallic Mo; and (2) The amounts of Ti and Mo appearing as solid solution in the bonding phase are controlled by addition of TiN.

Addition of metallic Mo rather than a carbide causes more Mo solid solution in the bonding phase. Metallic Mo is not necessarily pure Mo. It is acceptable to add molybdenum carbide ($Mo_2C$) together with metallic Mo as the main additional component.

For an enhanced bonding phase, Ti and Mo contents in the bonding phase must be in the range as follows: 6 Wt. %≦Ti+Mo and 1.0≦Mo (wt. %)/Ti (wt. %). By adding TiN together with TiC, it is possible to control Ti solid solution with increasing Mo solid solution in the bonding phase. However, excessive amount of TiN tends to lower the amount of C in the sintered subject with generating a fragile phase such as $(Co_3W_3)C$ or forming pores. Therefore, it is preferable that TiN amount is limited to 10 wt. % at most, and more preferably, is to be adjusted in the range from 2.0 wt. % to 6.0 wt. %. In this range the alloy can be provided with excellent properties in both of wear resistance and toughness.

The above two steps have another effect: the carbide (Ti, W, Mo) C constituting the peripheral structure is made finer. This reduces contacts among carbide particles, which improves the toughness.

In the conventional cermet alloy with TiC and WC added, the hard phase is provided with TiC surrounded by WC. It is found that, however, when Mo to be contained for bonding phase enhancement is added as metallic Mo and TiC is added as solid solution (TiCN or (Ti,W)C), the present cermet alloy has a novel metal microstructure where either of particles rich in TiC and particles rich in WC exists independently from the other and exhibits excellent heat resistance.

Figure 5:
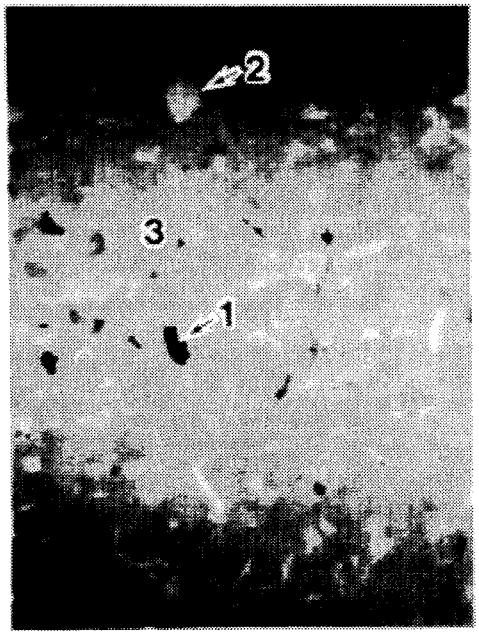
FIG. 5 is a photograph showing the metal microstructure (2400×) of the alloy No. 12 in Example 2.
Figure 7:
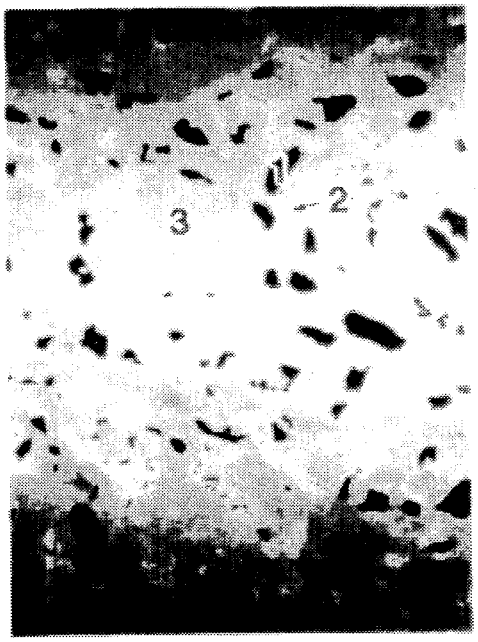
FIG. 7 is a photograph showing the metal microstructure (2400×) of the alloy No. 16 In Example 2.

FIGS. 5 and 7 are microstructure photographs of a cermet alloy according to the present invention (No. 12 in Example 2 below) and a comparative cermet alloy (No. 16 in Example 2 below) respectively. In FIG. 5, black particles (1) are rich in TiC content, white particles (2) are rich in WC and gray portion (3) in (Ti, W, Mo) C. Particles rich in TiC and those rich in WC exist independently from each other. In FIG. 7, black particles (1) are rich in TiC, white phase (2) is rich in WC, and gray portion (3) is rich in (Ti, W, Mo) (C, N). It is a structure where the phase rich in WC surrounds the particles rich in TiC.

Referring to specific examples, the present invention will be described in detail below.

EXAMPLE 1

Powders of TiC, TiN, WC, Mo, Co and Ni are prepared so as to form the composition as shown in Table 1. The average particle diameters of the powders are 1.5 μm for TiC, 1.5 μm for TiN, 1.5 μm for WC, 2.0 μm for Co, 2.5 μm for Ni and 3.0 μm for Mo. These material powders are put into denatured alcohol and mixed for four hours with attritor.

The amount of mixtures is adjusted so that TiC and WC as hard phase components represent 60 to 90 wt. %, Co and Ni as bonding phase components and Mo from independent addition represent 10 to 40 wt. %, and independently added TiN represents 0.5 to 10 wt. % of the total amount.

To the above mixtures, about 4 wt. % of plasticizer (paraffin) is added respectively as an auxiliary agent for forming. Then, the mixtures are dried, screened and formed into SNGN120408R (SNGN432R) (JIS) and sintered in vacuum at a temperature from 1475° to 1550° C.

TABLE 1

| | Composition (vol. %) | | | | | |
|---|---|---|---|---|---|---|
| | TiC | TiN | WC | Mo | Co | Ni |
| ○ 1 | 58.1 | 5.0 | 23.4 | 6.7 | 2.4 | 4.4 |
| ○ 2 | 58.1 | 5.0 | 21.4 | 8.7 | 2.4 | 4.4 |
| ○ 3 | 58.1 | 5.0 | 19.4 | 10.7 | 2.4 | 4.4 |
| ○ 4 | 58.1 | 5.0 | 18.4 | 11.7 | 2.4 | 4.4 |
| ○ 5 | 53.1 | 10.0 | 23.4 | 6.7 | 2.4 | 4.4 |
| ○ 6 | 53.1 | 10.0 | 21.4 | 8.7 | 2.4 | 4.4 |
| ○ 7 | 53.1 | 10.0 | 19.4 | 10.7 | 2.4 | 4.4 |
| Δ 8 | 80TiCN-6WC-7.4NbC-0.1$Mo_2C$-4.5Co-2Ni (wt. %) | | | | | |
| Δ 9 | 83TiCN-4WC-5$Mo_2C$-3TaC-3Co-2Ni (wt. %) | | | | | |

Using these samples, Vickers hardness, crack resistance (kg/mm) and solid solution of the elements in the bonding phase (wt. % when assuming the solution amount in the bonding phase as 100%) are determined.

Figure 13:
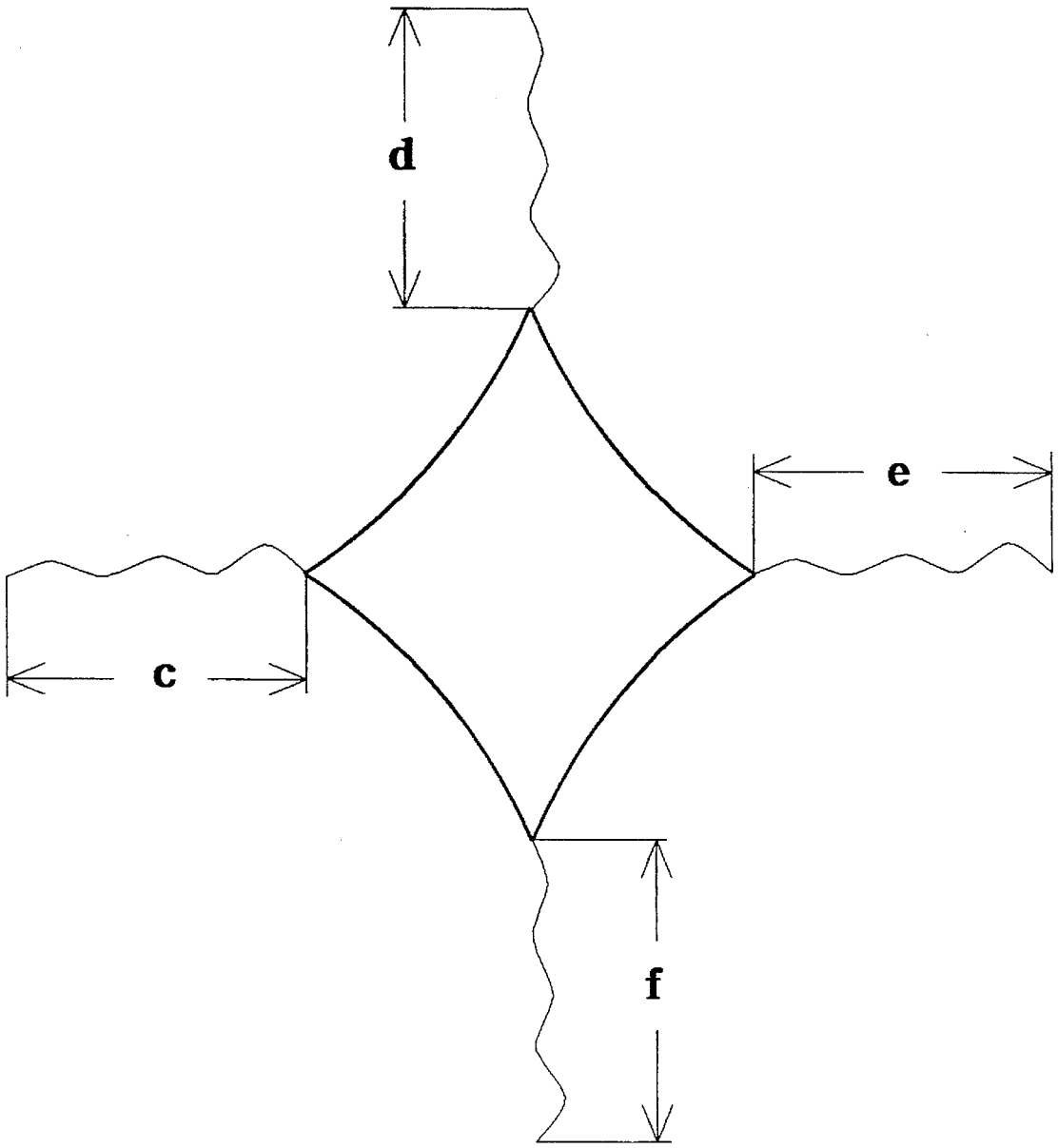
FIG. 13 is a diagram to show the method to determine the crack resistance.

Vickers hardness is obtained by applying a load of 30 kg with a diamond indenter and using the hardness conversion table (JIS). The crack resistance is determined by applying the following formula after measuring distances c, d, e and f as shown in FIG. 13 with a load of 50 kg applied also with a diamond indenter:

formula: load/(c+d+e+f).

The element solid solution in the bonding phase is obtained by determining the elements in the bonding phase by solving the bonding phase into aqueous mixed acid solution for extraction and applying ICP (inductively coupled plasma) emission spectral analysis.

Table 2 shows Vickers hardness, crack resistance (kg/mm) and solid solution (wt. %) of the elements in the bonding phase. In Tables 1 and 2, circles attached to sample Nos. indicate the alloys according to the present invention, and triangles indicate comparative alloys. These markings have the same meanings in the later tables, too.

TABLE 2

| | Bonding phase analysis (wt. %) | | | | | Ti + Mo (wt. | Ti + W + Mo (wt. | | Vickers Hardness | Crack Resistance |
|---|---|---|---|---|---|---|---|---|---|---|
| No. | Ti | W | Mo | Co | Ni1 | %) | %) | Mo/Ti | Hv | (kg/mm) |
| ○ 1 | 4.0 | 1.1 | 4.9 | 37.2 | 52.8 | 8.9 | 10.0 | 1.23 | 1720 | 52 |
| ○ 2 | 6.4 | 1.7 | 8.3 | 35.7 | 47.9 | 14.7 | 16.4 | 1.30 | 1720 | 67 |
| ○ 3 | 7.7 | 1.6 | 10.4 | 34.8 | 45.7 | 18.1 | 19.7 | 1.35 | 1660 | 80 |
| ○ 4 | 10.3 | 1.4 | 11.6 | 323.7 | 44.0 | 21.9 | 23.3 | 1.13 | 1640 | 80 |
| ○ 5 | 4.9 | 1.3 | 5.9 | 36.6 | 51.2 | 10.8 | 12.1 | 1.20 | 1820 | 52 |
| ○ 6 | 6.3 | 1.7 | 8.3 | 34.6 | 49.1 | 14.6 | 16.3 | 1.31 | 1720 | 66 |
| ○ 7 | 7.9 | 1.7 | 10.4 | 33.6 | 46.4 | 20.8 | 22.5 | 1.32 | 1680 | 63 |
| Δ 8 | 2.9 | 0.9 | 1.3 | 65.2 | 29.7 | 4.2 | 5.1 | 0.45 | 1740 | 45 |
| Δ 9 | 6.3 | 0.6 | 5.1 | 46.9 | 38.3 | 11.4 | 12.0 | 0.81 | 1730 | 42 |

All of the alloys according to the present invention have Vickers hardness of 1600 or more and a crack resistance of 50 (kg/mm) or more, which cannot be obtained by the comparative alloys Nos. 8 and 9.

FIG. 1 shows the relation between added Mo amount and hardness/crack resistance in Table 2. Increase of added Mo amount causes the hardness to reach a certain value and then decrease, but causes the crack resistance to raise straightly.

Figure 2:
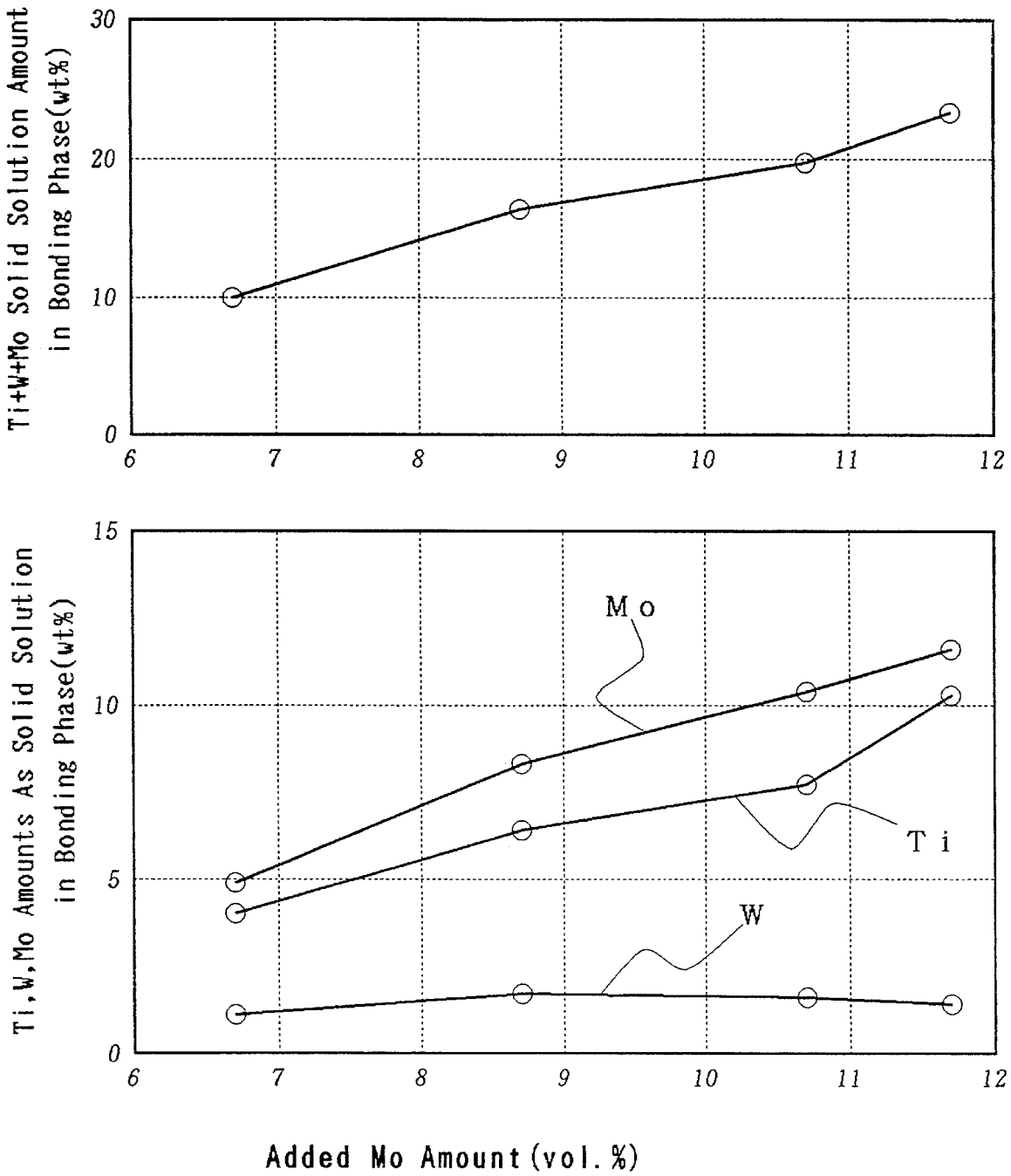
FIG. 2 is a graph to show the relation between added Mo amount and amount of Ti+W+Mo and solid solution amounts of Ti, W and Mo in the bonding phase when 5 vol. % of TiN is added in Example 1.

FIG. 2 shows the relation between added Mo amount and Ti, W and Mo amounts in the bonding phase in Tables 1 and 2. The figure indicates that the amounts of Ti and Mo increase as the added Mo amount increases.

Figure 3:
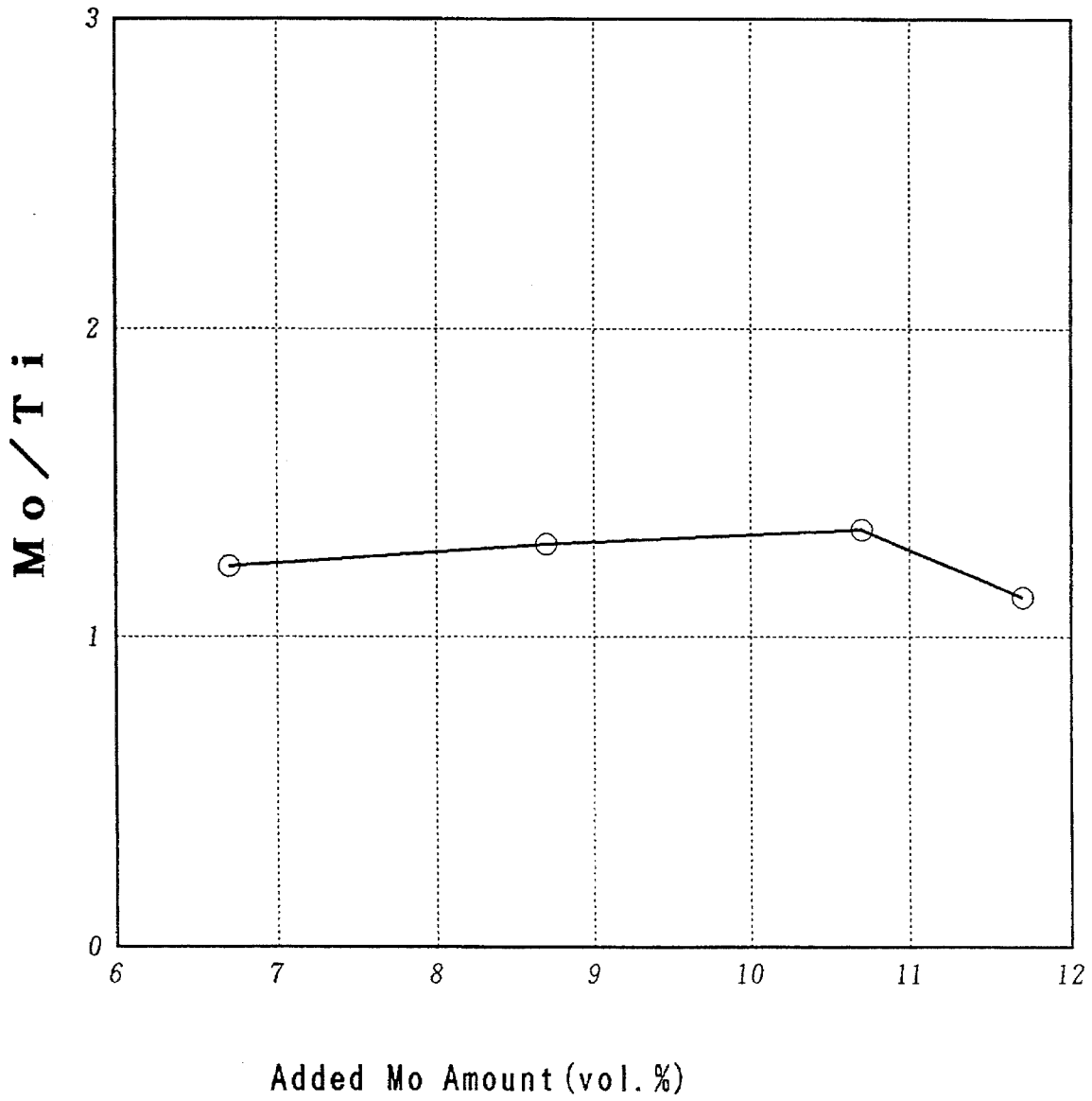
FIG. 3 is a graph to show the relation between added Mo amount and the amount ratio of Mo/Ti in the bonding phase when 5 vol. % of TiN is added in Example 1.

FIG. 3 shows an amount ratio of Mo (wt %)/Ti (wt %) in Table 2. There is a tendency that excessive addition of Mo causes Mo/Ti to decrease. As seen from FIG. 1, this substantially spoils the effect of crack resistance improvement.

Figure 4:
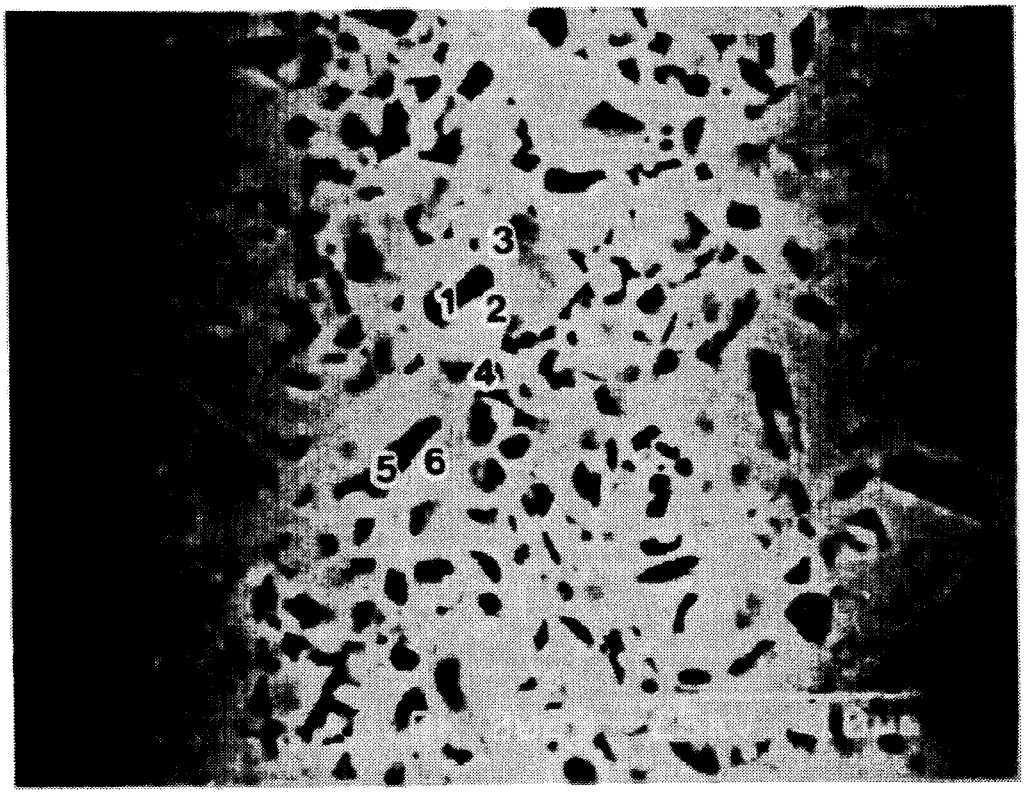
FIG. 4 is a photograph showing the metal microstructure (2400×) of a cermet alloy according to the present invention.

FIG. 4 shows the metal microstructure photograph (2400×) of No. 3 alloy in Table 2. In the figure, it is verified that the numerals 1 and 5 indicate the portions rich in TiC+TiN and numerals 2, 3, 4 and 6 indicate the portions rich in (Ti, W) (C, N) and containing slight amount of Mo. Co and Ni.

EXAMPLE 2

Powders of TiC, TaC, NbC, $Mo_2C$, WC, Mo, Co, Ni, WC/TiC (carbide solid solution with 50 wt. % of WC and 50 wt. of TiC) and Ti ($C_{0.5}N_{0.5}$) are prepared so as to form the composition as shown in Table 3. The average particle diameters of the powders are 1.5 μm for TiC, 1.5 μm for WC, 1.5 μm for TaC, 1.5 μm for NbC, 1.5 μm for $Mo_2C$, 2.0 μm for Co, 2.5 μm for Ni, 3.0 μm for Mo, 1.0 μm for WC/TiC (50/50) and 1.0 μm for Ti ($C_{0.5}N_{0.5}$).

These material powders are put into denaturalized alcohol and mixed for four hours with attritor.

The amount of mixtures is adjusted so that TiC, WC, WC/TiC (50/50) and Ti($C_{0.5}N_{0.5}$) as hard phase components represent 60 to 90 wt. % and Co and Ni as bonding phase components and independently added Mo represent 10 to 40 wt. % of the total amount.

TABLE 3

| | Composition (vol. %) | | | | | | | |
|---|---|---|---|---|---|---|---|---|
| | TiC | TiN | WC | Mo | Co | Ni | $TiC_{0.5}N_{0.5}$ | WC/TiC (50/50) |
| ○ 10 | 10.6 | — | — | 11.7 | 4.4 | 4.4 | — | 68.9 |
| ○ 11 | — | — | — | 11.7 | 4.4 | 4.4 | 5.2 | 74.3 |
| ○ 12 | — | — | — | 11.7 | 4.4 | 4.4 | 10.3 | 69.2 |
| ○ 13 | — | — | — | 11.7 | 4.4 | 4.4 | 15.4 | 64.1 |
| ○ 14 | — | — | — | 11.7 | 4.4 | 4.4 | 39.8 | 39.7 |
| ○ 15 | 38.3 | 5.4 | — | 10.7 | 3.4 | 3.4 | — | 38.8 |
| Δ 16 | 63.1 | — | 16.4 | 11.7 | 4.4 | 4.4 | — | — |
| Δ 17 | 72.2TiCN-10WC-6TaC-1.2Mo2C-5.3Co-5.3Ni (vol %) | | | | | | | |
| Δ 18 | 80TiCN-7WC-6.5NbC-4.5Co-2Ni (vol %) | | | | | | | |

With about 4 wt. % of plasticizer (paraffin) added as auxiliary agent, the mixtures above are dried and screened to form SNP432 (SNGN120408) (JIS), and subjected to vacuum sintering for one hour at a temperature from 1500° to 1550° C.

For the obtained alloy, Vickers hardness, crack resistance (kg/mm) and solid solution of the elements in the bonding phase (wt. % when assuming the solution amount in the bonding phase as 100%) are determined. Determination methods are the same as in Example 1.

Table 4 shows Vickers hardness, crack resistance, Ti+Mo amount (wt. %) and Ti+W+Mo amount (wt. %) and Mo(wt. %)/Ti(wt. %) in the bonding phase.

TABLE 4

| No. | Bonding phase analysis (wt. %) Ti | W | Mo | Co | Nil | Ti + Mo (wt. %) | Ti + W + Mo (wt. %) | Mo/Ti | Vickers Hardness Hv | Crack Resistance (kg/mm) |
|---|---|---|---|---|---|---|---|---|---|---|
| ○ 10 | 14.9 | 1.4 | 13.8 | 39.2 | 30.4 | 28.7 | 30.1 | 1.02 | 1510 | 86 |
| ○ 11 | 7.2 | 1.3 | 8.5 | 43.1 | 39.9 | 15.7 | 17.0 | 1.18 | 1660 | 66 |
| ○ 12 | 13.6 | 1.5 | 14.0 | 37.9 | 32.9 | 27.6 | 29.1 | 1.03 | 1530 | 81 |
| ○ 13 | 10.0 | 1.4 | 10.3 | 43.3 | 35.1 | 20.3 | 21.7 | 1.03 | 1600 | 70 |
| ○ 14 | 14.1 | 1.6 | 14.0 | 33.4 | 33.6 | 28.1 | 29.7 | 1.01 | 1350 | 53 |
| ○ 15 | 8.4 | 1.1 | 8.9 | 39.2 | 42.3 | 17.3 | 18.4 | 1.06 | 1520 | 75 |
| Δ 16 | 14.5 | 1.7 | 13.7 | 41.0 | 29.1 | 28.2 | 29.9 | 0.94 | 1610 | 87 |
| Δ 17 | 2.3 | 1.8 | 1.8 | 49.2 | 44.8 | 4.1 | 5.9 | 0.78 | 1450 | 90 |
| Δ 18 | 2.9 | 0.9 | 1.3 | 65.2 | 29.7 | 4.2 | 5.1 | 0.45 | 1740 | 50 |

FIGS. 5 to 8 show the microstructure photographs of the alloys Nos. 12, 14, 16 and 17. Nos. 12 and 14 are alloys according to the present invention where Ti carbide is added as TiCN and WC/TiC solid solution and Mo is added as metallic Mo. No. 16 indicates a comparative alloy where Mo is added as metallic Mo but Ti carbide is added as Ti C, and No. 17 is another comparative alloy where Ti carbide is added as TiCN solid solution but Mo is added as $Mo_2C$.

Figure 6:
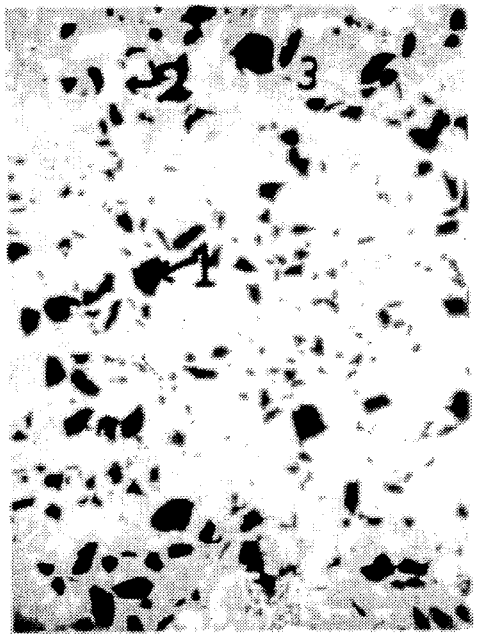
FIG. 6 is a photograph showing the metal microstructure (2400×) of the alloy No. 14 in Example 2.

In FIGS. 5 and 6, black particles (1) are those rich in TiC, white particles (2) indicate those rich in WC and the gray phase (3) is (Ti, W, Mo) C. It is learned that particles rich in TiC and those rich in WC exist independently. Black particles comprise 90% of TiC and (W, Mo) C for the remaining part; among white particles, WC represents 70% and the remaining part is TiC. The gray phase (3) is a carbide rich in TiC and WC and containing slight amount of Mo, Co and Ni. There exist particles rich in WC.

According to comparison of FIGS. 5 and 6, the difference in TiCN (nitrogen) amount affects the white phase amount. It is considered that it exists as (W, Ti, Mo) (C, N). When some TiCN is added as in FIG. 4, however, it is verified that it exists as WC. Such structure configuration is different from conventional alloys.

Figure 8:
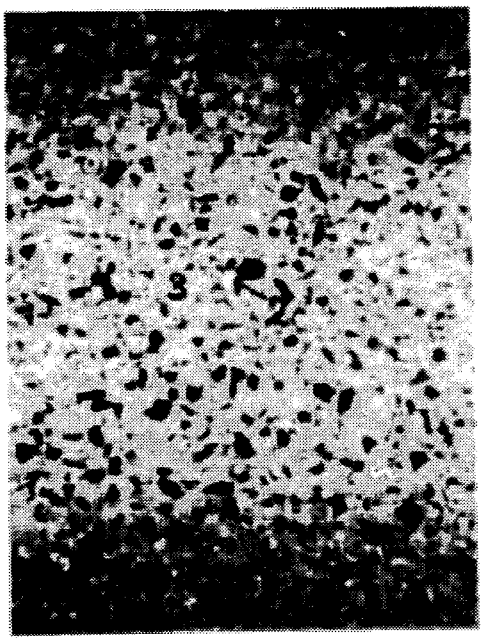
FIG. 8 is a photograph showing the metal microstructure (2400×) of the alloy No. 17 in Example 2.

Referring to FIGS. 7 and 8, on the other hand, black particles (1) rich In TiC are surrounded by white particles (2) rich in WC and further covered with the gray phase (3) (Ti, W, Mo)C. It is verified that the particles rich in TiC and those rich in WC do not exist independently. Thus, addition of Ti carbide as solid solution together with metallic Mo addition is considered to causes such independent existence of particles rich in TiC and those rich in WC. Similarly, it is verified that the alloys of Nos. 10, 11, 13 and 15 have, as in Nos. 12 and 14, particles rich in TiC and those rich in WC existing independently.

For the materials of Nos. 12, 14 and 17 and No. 19 in Example 3 described later, the ratios of the carbides rich in TiC to those rich in WC in the total alloy structure area are determined and shown in Table 5.

TABLE 5

| No. | TiC rich carbide / WC rich carbide |
|---|---|
| ○ 12 | 0.32 |

TABLE 5-continued

| No. | TiC rich carbide / WC rich carbide |
|---|---|
| ○ 14 | 0.96 |
| Δ 17 | 1.74 |
| ○ 19 | 0.41 |

Table 5 indicates that, while the conventional material No. 17 has more carbides rich in TiC than those rich in WC, the alloys of Nos. 12, 14 and 19 has more carbides rich in WC than those rich in TiC.

Then, tools made of the above alloys are used for wet machining. Since wet machining involves tool temperature rise during machining and tool temperature lowering due to machining fluid, the machining service life can be used as an index of heat resistance evaluation of a tool material.

Machining conditions are as follows:

Cutting velocity: V=220 m/min.

Feed rate: f=0.35 mm/rev

Cutting depth: d=2.0 mm

Tool shape: TNGG160408R (JIS)

Work material: S53C (JIS)

Figure 9:
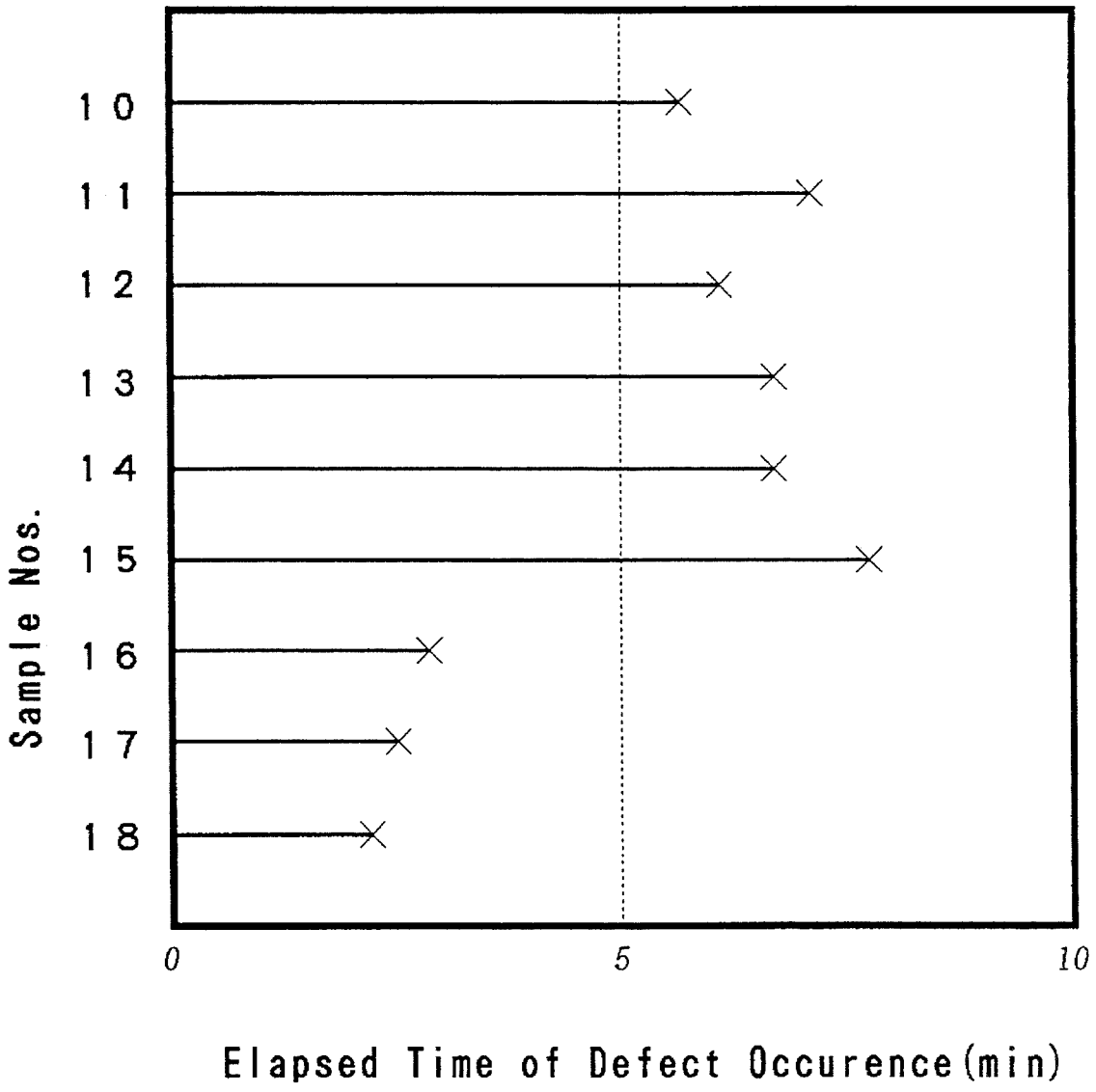
FIG. 9 is a graph to show evaluation results for wet machining according to Example 2.

Under the conditions above, the time until any defect occurs at the tool is clocked and shown In FIG. 9. Nos. 10 to 15 according to the present invention show longer service lives than comparative alloys (Nos. 16 to 18). This means that the present alloys have higher heat resistance. Independent existence of particles rich In TiC and those rich in WC is considered to contribute to improvement of the heat resistance of the present alloys as they have comparable hardness and toughness to the comparative alloys as shown in Table 4.

Figure 10:
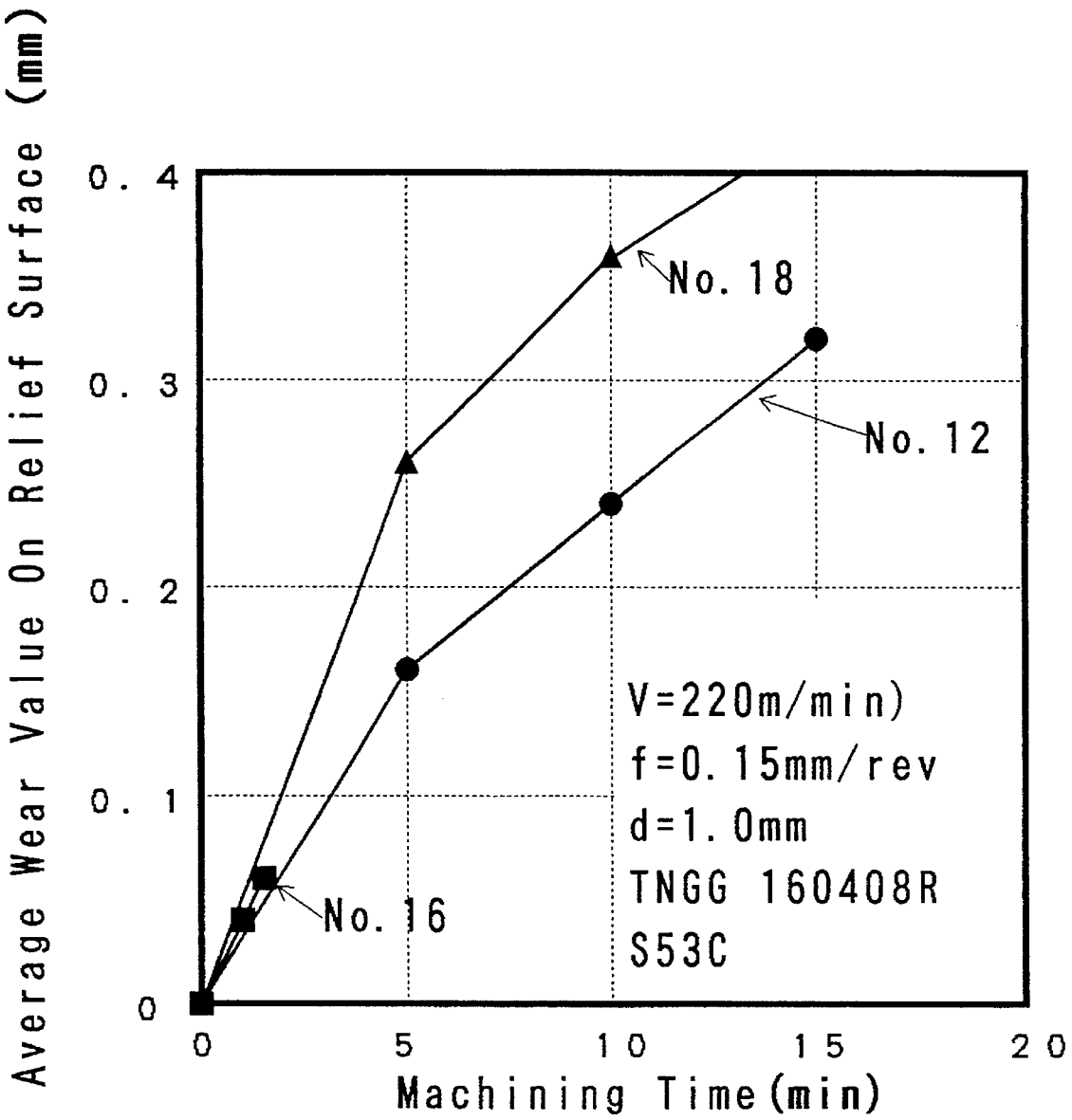
FIG. 10 is a graph showing the results of wear resistance evaluation in Example 2.

The wear resistance is evaluated for tools made of the alloys of Nos. 12, 16 and 18 and shown in FIG. 10. Machining conditions are as follows. Wet machining is again adopted from the same viewpoint as the heat resistance evaluation.

Cutting velocity: V=220 m/min.

Feed rate: f=0.15 mm/rev

Cutting depth: d=2.0 mm

Tool shape: TNGG160408R (JIS)

Work material: S53C (JIS)

The alloy No. 16 had a defect in early stage but no defect occurred for the alloys No. 12 and 18. No. 18 had, however, much wear on the relief surface.

EXAMPLE 3

With varying the bonding phase amount of No. 12 alloy in Example 2, other materials are prepared. Table 6 shows the compositions.

TABLE 6

| | Composition (vol. % for the upper and wt. % for the lower) | | | | | | | |
|---|---|---|---|---|---|---|---|---|
| | TiC | TiN | WC | Mo | Co | Ni | $TiC_{0.5}N_{0.5}$ | WC/TiC (50/50) |
| ○ 12 | — | — | — | 11.7 | 4.4 | 4.4 | 10.3 | 69.3 |
| | — | — | — | 15.6 | 5.1 | 5.1 | 6.8 | 67.4 |
| ○ 19 | — | — | — | 11.7 | 4.9 | 4.9 | 10.3 | 68.2 |
| | — | — | — | 15.6 | 5.6 | 5.6 | 6.8 | 66.4 |
| ○ 20 | — | — | — | 11.7 | 5.4 | 5.4 | 10.3 | 69.2 |
| | — | — | — | 15.6 | 6.3 | 6.3 | 6.8 | 65.0 |

Table 7 shows Vickers hardness and crack resistance of the alloys Nos. 12, 19 and 20. Increase of Co+Ni amount reduces the hardness with increasing tile crack resistance. The crack resistance improves by about 10 kg/mm when added Co+N increases by 1 vol %.

TABLE 7

| | Bonding phase analysis (wt. %) | | | | | | | | | |
|---|---|---|---|---|---|---|---|---|---|---|
| No. | Ti | W | Mo | Co | Nil | Ti + Mo (wt. %) | Ti + W + Mo (wt. %) | Mo/Ti | Vickers Hardness Hv | Crack Resistance (kg/mm) |
| ○ 12 | 9.9 | 1.2 | 14.6 | 41.1 | 33.2 | 24.5 | 25.7 | 1.47 | 1530 | 81 |
| ○ 19 | 10.8 | 1.3 | 14.9 | 38.8 | 34.1 | 25.7 | 27.0 | 1.38 | 1510 | 98 |
| ○ 20 | 12.0 | 1.8 | 15.0 | 36.0 | 35.2 | 27.0 | 28.8 | 1.25 | 1470 | 107 |

Figure 11:
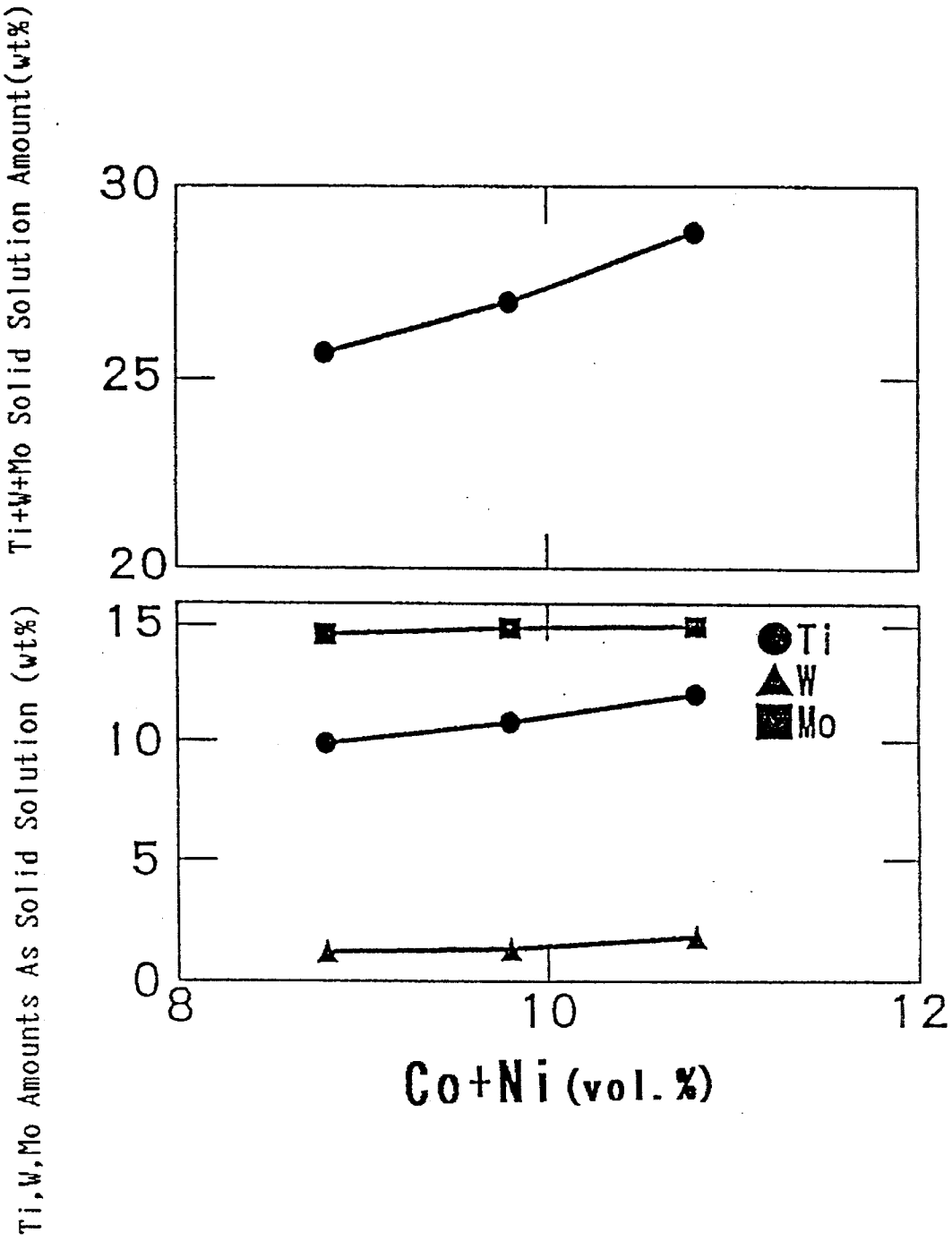
FIG. 11 is a graph to show the relation between the amount of Co+Ni and solid solution amounts of Ti, W and Mo in the bonding phase in Example 3.

FIG. 11 shows the relation between Co+Ni amount and Ti, W and Mo amounts and Ti+W+Mo amount in the bonding phase. Even when the amount of Co+Ni changes, the amounts of Ti, W and Mo existing as solid solution in the bonding phase does not change significantly. In particular, Mo solid solution is almost constant.

Figure 12:
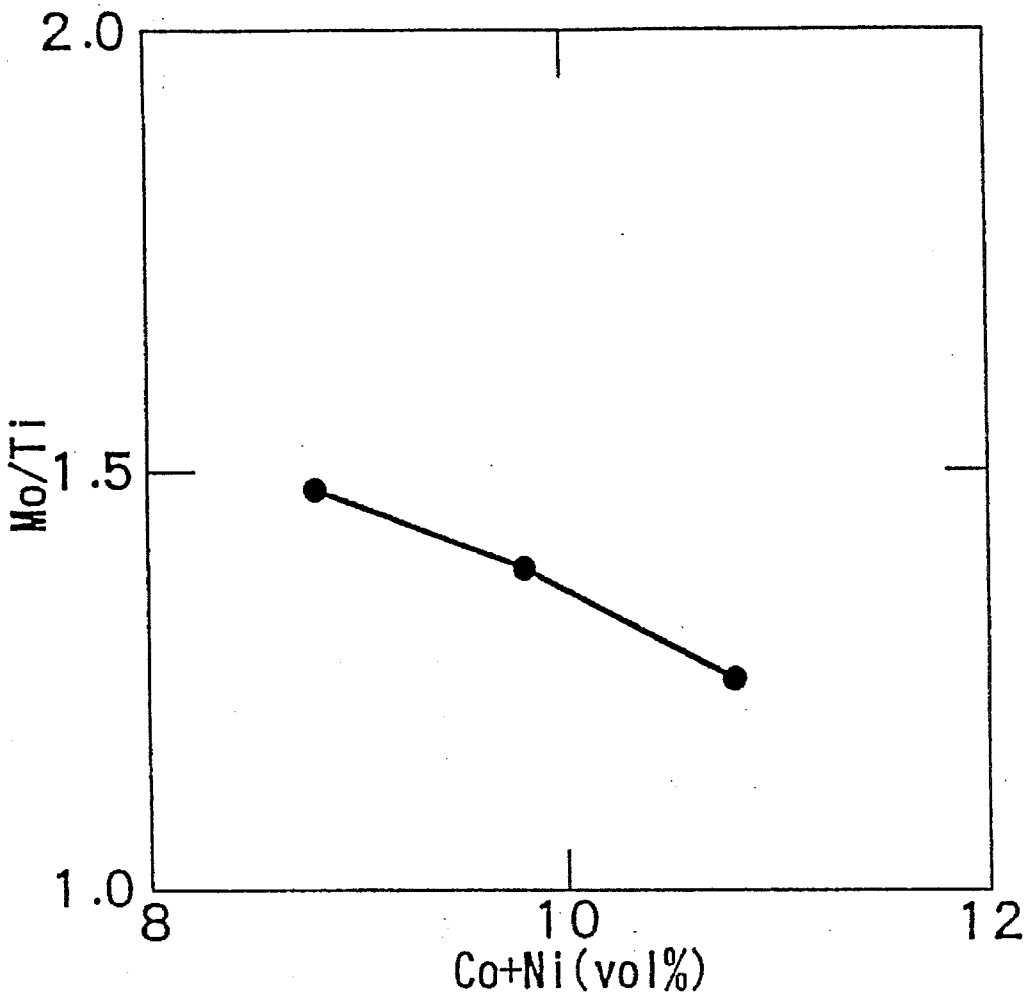
FIG. 12 is a graph to show the relation between the amount of Co+Ni and the amount ratio of Mo/Ti in the bonding phase in Example 3.

FIG. 12 shows the relation between Co+Ni amount and the amount ratio of Mo/Ti. Mo/Ti is always high with a value of 1 or more, but when the amount of Co+Ni increases, Mo/Ti tends to decrease.

Using tools made of the alloys Nos. 12, 19 and 20 in Table 7 and Nos. 17 and 18 In Table 4, the defect resistance during intermittent machining and tile wear resistance during continuous machining are evaluated. Machining conditions are as follows:

Intermittent machining:
- Cutting velocity: V=220 m/min.
- Feed rate: f=0.35 mm/rev
- Cutting depth: d=1.0 mm
- Tool shape: TNGG160408R (JIS)
- Work material: SCM435 (JIS)

Continuous machining:
- Cutting velocity: V=220 m/min.
- Feed rate: f=0.15 mm/rev
- Cutting depth: d=1.0 mm
- Tool shape: TNGG160408R (JIS)
- Work material: S53C (JIS)

Table 8 shows the evaluation results. Tables 7 and 8 show that the alloy No. 19 with 9.8 vol. % of Co+Ni is excellent both in defect resistance and wear resistance.

TABLE 8

| No. | Defect Resistance (Impact Nos.) V = 220 m/min, f = 0.15 mm/rev, d = 1.0 mm | Wear Resistance Defect Occurence Time (min) |
|---|---|---|
| ○ 12 | 4700 | 5 |
| ○ 19 | 6250 | 8 |
| ○ 20 | 2000 | 2 |
| Δ 17 | 300 | 3 |
| Δ 18 | 200 | 2 |

As described above, structure control with proper addition of metallic Mo and Ti solid solution enables forming of cermet alloy with high hardness, toughness and heat resistance.

What is claimed is:

1. A cermet alloy having a structure comprising 60 to 90 wt. % of a hard phase and 10 to 40 wt. % of a bonding phase, said hard phase comprising titanium carbide and titanium nitride or titanium carbide-nitride, and said bonding phase mainly comprising at least one of Co and Ni, and further comprising Ti and Mo, wherein the Ti and Mo contents in the bonding phase satisfy the following conditions: 1.0≦Mo (wt. %)/Ti (wt. %) and 6 (wt. %)≦Ti+Mo.

2. The cermet alloy according to claim 1, wherein the hard phase comprises carbide particles rich in TiC, those rich in WC as well as (Ti, W, Mo) C.

3. A cermet alloy having a structure comprising 60 to 90 wt. % of a hard phase and 10 to 40 wt. % of a bonding phase, said hard phase comprising titanium carbide and titanium nitride or titanium carbide-nitride, said bonding phase comprising at least one of Co and Ni and further comprising Ti, Mo and W, wherein the Ti, Mo and W contents in the bonding phase satisfy the following conditions: 1.0≦Mo (wt. %)/Ti (wt. %) and 7 (wt. %)≦Ti+Mo+W.

* * * * *